US007659463B2

(12) United States Patent
Twu

(10) Patent No.: US 7,659,463 B2
(45) Date of Patent: Feb. 9, 2010

(54) VIOLA/VIOLIN SHOULDER REST

(76) Inventor: Hwei-Ming Twu, 14F-1, No. 137, San Dwo 3rd Rd., Chian Chen District, Kaohsiung City (TW)

( * ) Notice: Subject to any disclaimer, the term of this patent is extended or adjusted under 35 U.S.C. 154(b) by 406 days.

(21) Appl. No.: 11/619,519

(22) Filed: Jan. 3, 2007

(65) Prior Publication Data

US 2008/0156169 A1 Jul. 3, 2008

(51) Int. Cl.
*G10D 3/18* (2006.01)

(52) U.S. Cl. ..... 84/280; 84/278

(58) Field of Classification Search ..... 84/278, 84/280

See application file for complete search history.

(56) References Cited

U.S. PATENT DOCUMENTS 908,541 A * 1/1909 Becker ..... 84/278
1,156,925 A * 10/1915 Poehland ..... 84/280
1,756,676 A * 4/1930 Colbentson ..... 84/280
2,064,925 A * 12/1936 Kolitsch ..... 84/280
2,110,023 A * 3/1938 Mcgowan ..... 84/280
2,208,824 A * 7/1940 Weinberg ..... 84/280
2,248,854 A * 7/1941 Delos et al. ..... 84/280
2,489,101 A * 11/1949 Mills ..... 84/280
3,690,211 A * 9/1972 Long ..... 84/280
3,896,694 A * 7/1975 Goldner ..... 84/280
4,084,477 A * 4/1978 Dominguez ..... 84/327
4,884,487 A * 12/1989 Feldkamp ..... 84/280
5,377,573 A * 1/1995 Tretick ..... 84/280
5,507,213 A * 4/1996 Beseke ..... 84/280
5,585,581 A * 12/1996 Rogers ..... 84/414
5,617,595 A * 4/1997 Landi et al. ..... 5/653
5,883,315 A * 3/1999 Kaplan et al. ..... 84/279
6,143,964 A * 11/2000 Chen ..... 84/280
6,239,337 B1 * 5/2001 Stein ..... 84/279
6,356,448 B1 * 3/2002 DiBene et al. ..... 361/721
6,624,346 B2 * 9/2003 Standish ..... 84/280
7,064,258 B2 * 6/2006 Mea ..... 84/278
7,226,484 B2 * 6/2007 Chen ..... 623/36

(Continued)

OTHER PUBLICATIONS

Spacers and Standoffs, © 2004, widely used and distributed for fastening posts, viewed Mar. 24, 2009 at www.aboveboardelectronics.com/hardware/Spacers-standoffs.htm.*

(Continued)

*Primary Examiner*—Jeffrey Donels
*Assistant Examiner*—Robert W Horn
(74) *Attorney, Agent, or Firm*—WPAT, P.C.; Anthony King; Kay Yang

(57) ABSTRACT

A viola/violin shoulder rest includes a first pad and a second pad made of soft foamed plastic material. A retainer is fixed between the first pad and the second pad. Each of the first pad and the second pad is formed with a sound reflection area which is a through hole. The sound reflection area of the first pad is alternatively stuffed with a natural sponge block. The sponge block is selectively coated at its top a gold foil. A number of feet made of silicon gel are fixed on the first pad in delta arrangement. A number of fastening posts are disposed on an upper surface of the retainer. A resilient band extends through where between the retainer and the second pad for the viola/violin player to deliver optimal sound color and quality.

8 Claims, 11 Drawing Sheets

U.S. PATENT DOCUMENTS

| | | | | |
|---|---|---|---|---|
| 7,262,352 | B1 * | 8/2007 | Lavorata | 84/279 |
| 7,492,598 | B2 * | 2/2009 | Narasimhan et al. | 361/719 |
| 2003/0025363 | A1 * | 2/2003 | Gaggiola | 297/195.1 |
| 2003/0041718 | A1 * | 3/2003 | Standish | 84/280 |
| 2008/0156169 | A1 * | 7/2008 | Twu | 84/280 |
| 2009/0016843 | A1 * | 1/2009 | Komsitsky et al. | 411/105 |

OTHER PUBLICATIONS

Triangle Shaped Mouse Pad, © 2005-2009, The Executive Advertising, teaching a pad in triangle shape, viewed Mar. 24, 2009 at www.theexecutiveadvertising.com/triangleshapedmousepad.aspx.*

Play on Air Shouldter Rests, corresponds to Goldner (U. S. Patent 3,896,694), viewed Mar. 24, 2009 at www.stamellstring.com/pages/SR_VN_PlayNairDlux.html.*

Stand-off Spacers, © 2003 Seastrom Manufacturing, example of fastening posts, viewed Mar. 24, 2009 at www.seastrom-mfg.com/seastrom_manufacturing_catalog/Engineering/eng.standoffspacers.htm.*

* cited by examiner

VIOLA/VIOLIN SHOULDER REST

BACKGROUND OF THE INVENTION (a) Field of the Invention

The present invention relates to a viola/violin shoulder rest, and more particularly, to one comprising a first pad having its sound reflection area made in a configuration of a through hole, or is placed with a natural sponge block or a natural sponge block with a gold foil to help present optimal tone quality and color in the performance of playing a solo, chamber music or concerto.

(b) Description of the Prior Art

Shoulder rests for viola/violin generally available in the market are each usually provided with an arc shoulder pad (A) for placing on the shoulder of the player as illustrated in FIG. 10 of the accompany drawings. Two adjusting members (A1) are respectively disposed to both ends of the shoulder pad (A). Though both adjusting members (A1) allow angular adjustment, the response of sound quality during playing of the violin is poor because the shoulder pad (A) is made of hard material, heavier, and provides poor resilience, and its angle is limited when placed upon the shoulder of the player. Furthermore, whereas the soundboard of the violin has both ends fixed to the adjustment members (A1), the soundboard is subject to comparatively greater pressure to result in muffled and weak resonance and prevent resonance from being felt. The shoulder rest tends to be biased in angular adjustment while the sound quality is compromised due to that the coating of the soundboard can easily fall off as a result of frequent friction between the shoulder pad (A) and the viola/violin.

In a common airbag shoulder rest (C) as illustrated in FIG. 11, two resilient bands (C1) are provided to the shoulder rest (C) to fasten the soundboard (B) of the viola/violin. The shoulder rest (C) though yields better resilience also affects the sound quality of the performance due to excessively larger contact area between the shoulder rest (C) and the soundboard (B).

SUMMARY OF THE INVENTION

The primary purpose of the present invention is to provide a viola/violin shoulder rest to improve shortcomings found with the prior art. To achieve the purpose, the present invention comprises a first pad and a second pad each in a triangle and made of soft foamed plastic material; a retainer is fixed between the first pad and the second pad; and a sound reflection area is each provided to the first and the second pads. The sound reflection area is defined by a through hole. Multiple feet each made of silicon gel are fixed in a triangular arrangement on the first pad, and a resilient band protrudes from where between the retainer and the second pad.

The sound reflection area of the first pad is stuffed with a piece of natural sponge block.

The top of the natural sponge block is coated with a gold foil.

Each foot indicates a ball shape.

Multiple fixation holes are disposed on the first pad and the second pad, and the retainer is provided with multiple fastening posts for insertion of screws. Each screw is engaged to a threaded hole of the fastening post and the top of the screw is disposed with a recess to receive insertion of the foot.

Two fillisters are disposed on a top surface of the second pad to accommodate the resilient band.

The soft foamed plastic material of the second pad is harder than that of the first pad.

The second pad has an arc bottom surface.

The present invention provides the following features:

1. The present invention has a delta contact with the soundboard for reduced contact area between the first pad and the soundboard so as to prevent affecting sound quality resulted from damaged coating of the soundboard.

2. The ergonomic design of a triangle configuration of the present invention and the arc bottom surface of the second pad allows it to rest on the socket of the shoulder minimize the unnecessary contact area between the shoulder rest and the shoulder of the player.

3. While playing the viola/violin, the player may readjust the balance of the soundboard at any time as desired to deliver the optimal contrast tone of sound among the treble or base strings.

4. The shoulder rest of the present invention is light and comfortable to cause extra burden to the player because both pads of the present invention are made of light-weighted foamed plastic material, and the soft foamed plastic material of the second pad is harder than that of the first pad.

5. The present invention allows the soundboard to contribute more harmonic and resonant sound quality because the shoulder rest contact is not in the fashion of having two ends to clamp the soundboard as found with the conventional type of shoulder rest.

6. The present invention is available in L, M, and S sizes to allow easy operation and comfortable use depending on the age of the player.

7. The reflection area of the present invention may be made in a configuration of a through hole, or stuffed with a piece of natural sponge block with its top coated with a gold foil or not to create different tone colors depending on whether the performance is solo, chamber music or concerto.

8. By turning the screw below the foot, the angle of the first pad can be easily adjusted to achieve a balanced status so as to provide the best timbre, i.e. the inside foot is not adjusted, one of the outside feet is adjusted to half, and the other of the outside feet is adjusted to the highest, alternatively, all of the three feet may be adjusted to a desired height in a balanced status.

DETAILED DESCRIPTION OF THE PREFERRED EMBODIMENTS

Figure 1:
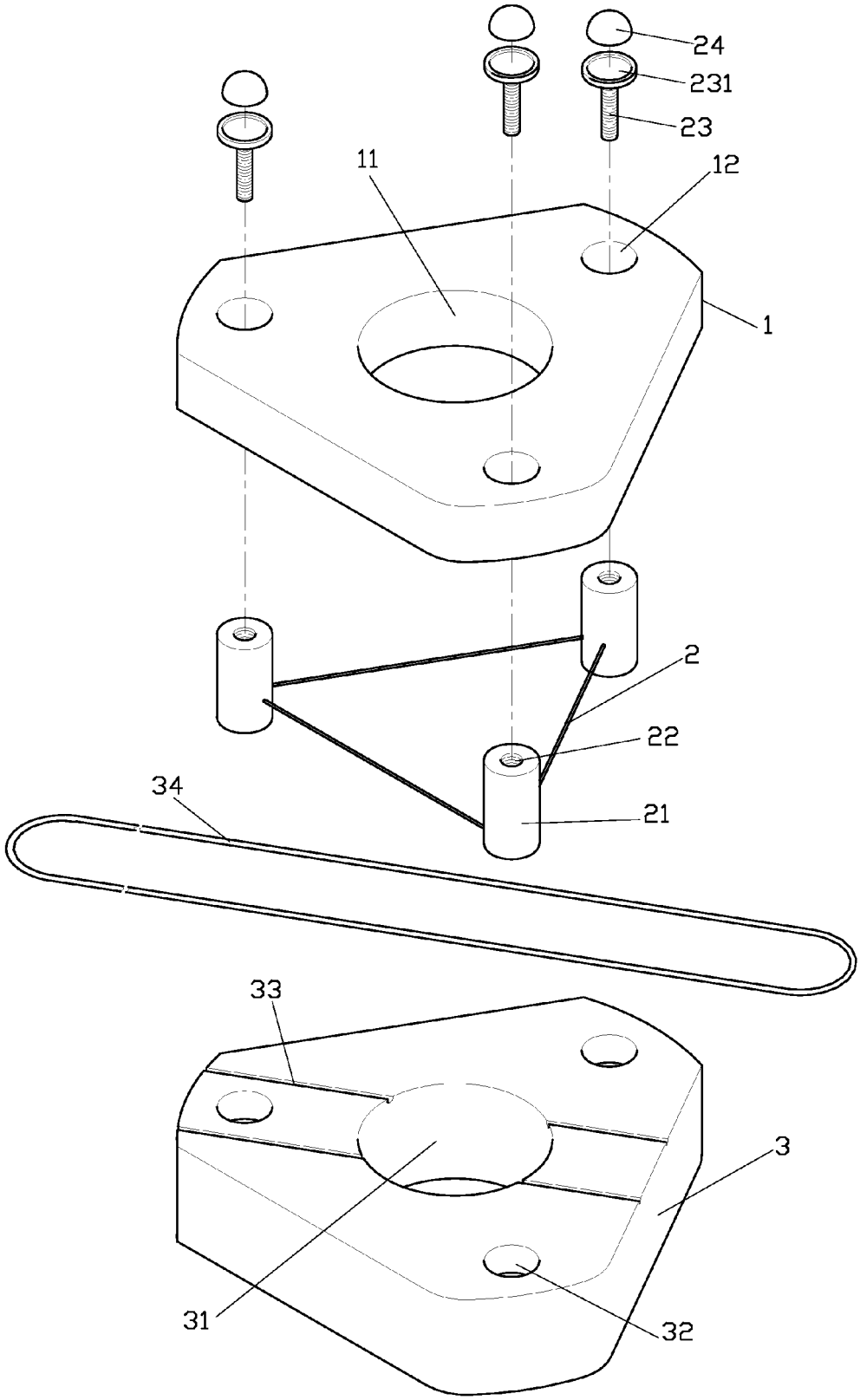
FIG. 1 is an exploded view of a first preferred embodiment of the present invention.

Referring to FIG. 1, a first preferred embodiment of the present invention comprises a first pad (1), a retainer (2), and a second pad (3).

The first pad (1) indicating a triangle is made of soft foamed plastic material. A sound reflection area (11) in the form of a through hole is bored at the center of the first pad (1), and multiple fixation holes (12), three in this preferred embodiment, are disposed on the first pad (1).

The retainer (2) is made of hard plastic material in the same form as that of the first pad (1). The retainer (2) comprises a plurality of fastening posts (21), three in this preferred embodiment, corresponding in position to the fixation holes (12) of the first pad (1). Each fastening post (21) is disposed with a threaded hole (22) for insertion of a screw (23). The top of the screw (23) is disposed with a recess (231) to receive a ball foot (24) made of silicon gel. Three feet (24) in delta arrangement to indicate a configuration of delta support.

Figure 2:
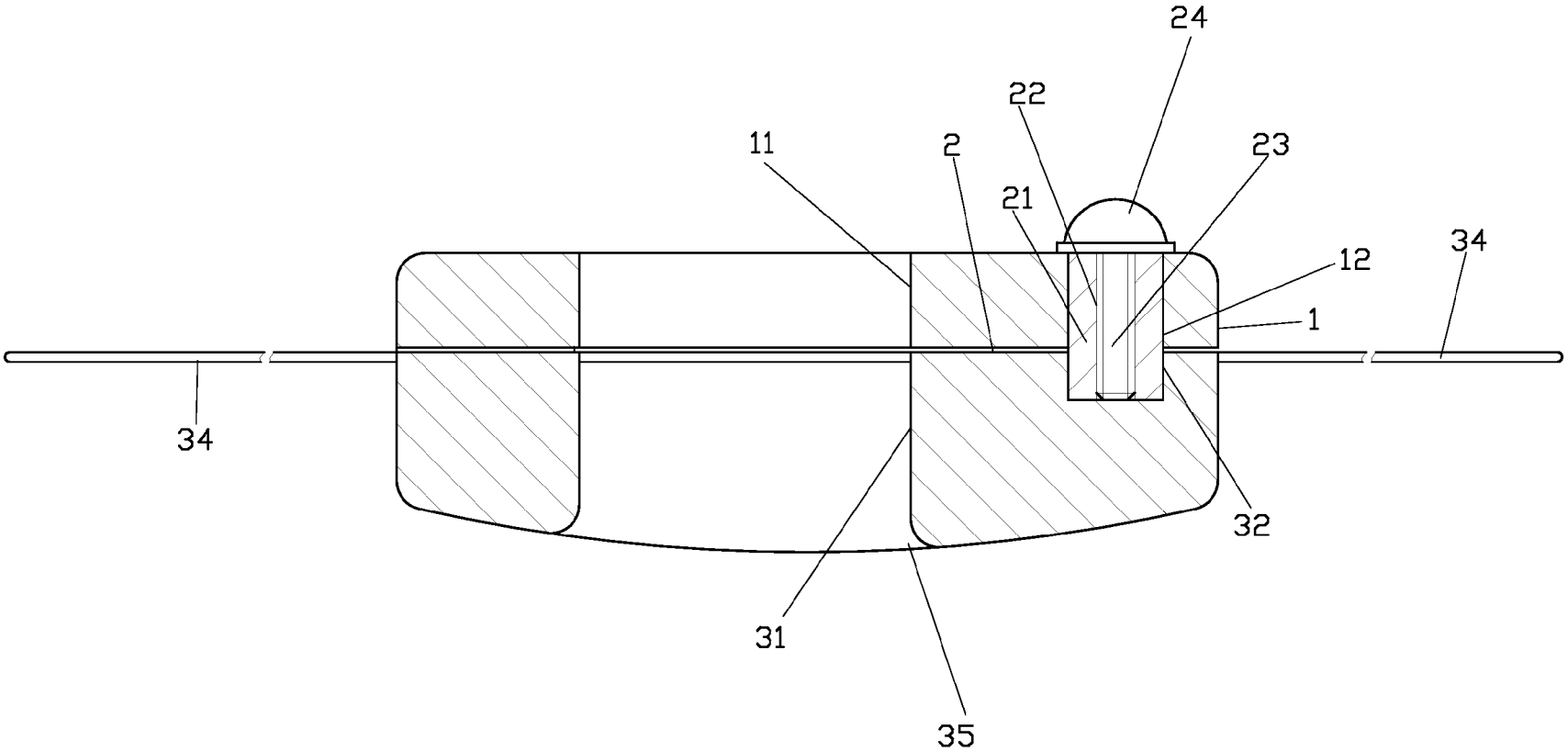
FIG. 2 is a sectional view of the first preferred embodiment of the present invention.

The second pad (3) is made of soft foamed plastic material and in the same form as that of the first pad (1). The second pad (3) has an arc bottom surface (35), as shown in FIG. 2. The soft foamed plastic material of the second pad (3) is harder than that of the first pad (1). A through hole is disposed at the center of the second pad (3) to define another sound reflection area (31). The second pad (3) comprises fixation holes (32) and two fillisters (33) disposed on the top of the second pad (3) to accommodate a resilient band (34).

When assembled as illustrated in FIG. 2, the resilient band (34) is placed on the fillisters (33) and exposed out of both sides of the second pad (3). The lower portion of each fastening post (21) of the retainer (2) is inserted into and stuck to the fixation hole (32) of the second pad (3), while the upper portion of each fastening post (21) is inserted through the fixation hole (12) of the first pad (1) with the screw (23) screwing into the threaded hole (22) of the fastening post (21) to secure the first pad (1) and the retainer (2) together. Each foot (24) is secured on the top of the screw (23). The first pad (1), the retainer (2), and the second pad (3) are assembled together.

Figure 3:
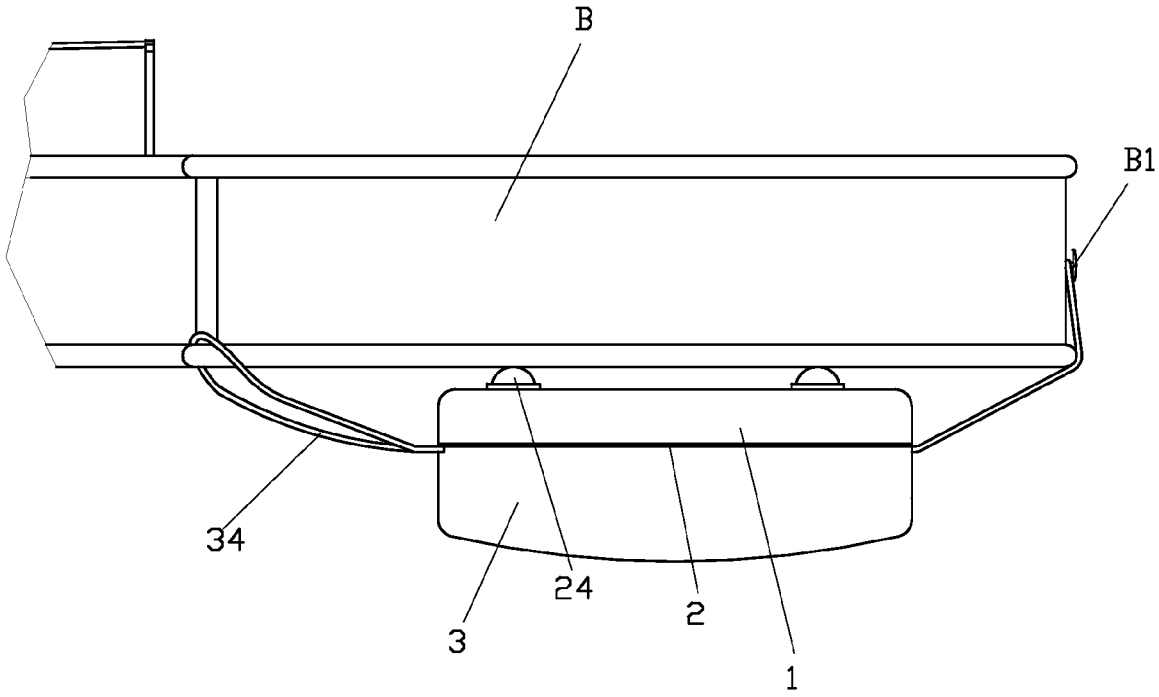
FIG. 3 is a schematic view showing an operating status of the first preferred embodiment of the present invention.
Figure 4:
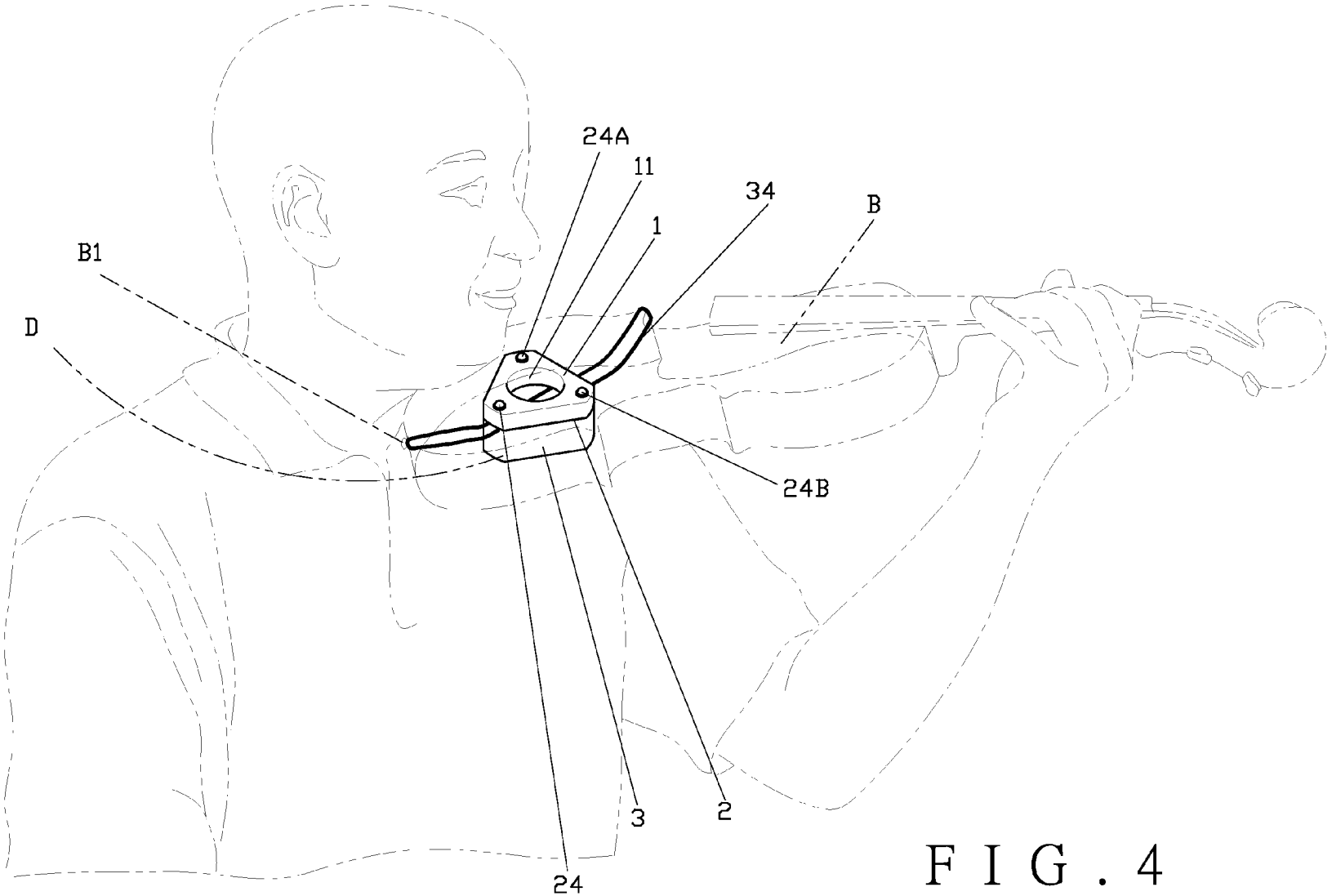
FIG. 4 is a schematic view showing that the first preferred embodiment of the present invention is placed on a socket of the shoulder of a player.

In practice, the resilient band (34) is tied and secured to an end button (B1) of a tailpiece (B), as illustrated in FIG. 3, with the second pad (3) holding against a shoulder socket (D) of the player as illustrated in FIG. 4. The soft foamed plastic material of the second pad (3) is harder than that of the first pad (1). By taking advantage of the delta contact provided by the second pad (3) to hold against the shoulder socket (D) also indicating a triangle, the tailpiece (B) is able to hold tightly against the feet (24) of the first pad (1) and subject to the internal delta support by the feet (24) for achieving ergonomically complying contact. The contact helps reduce the contact area between the first pad (1) and the tailpiece (B) without damaging the coating of the tailpiece (B). Therefore, the original sound quality will not be affected. By turning the section of the screw (23) below the foot (24), the angle of the first pad (1) can be easily adjusted to achieve a balanced status. For detail explanation, as shown in FIG. 4, the inside foot (24) is not adjusted. One of the outside feet (24A, 24B) is adjusted to half, and the other of the outside feet (24A, 24B) is adjusted to the highest. Alternatively, all of the three feet (24, 24A, 24B) may be adjusted to a desired height in a balanced status so as to provide the best timbre. Whereas the tailpiece (B) is at where opposite to the sound reflection area (11) of the first pad (1), the through hole configuration of the sound reflection area (11) is particularly idea for the performance of solo or duo by delivering proper resonance of the sound color without getting too high or suppressed.

Figure 5:
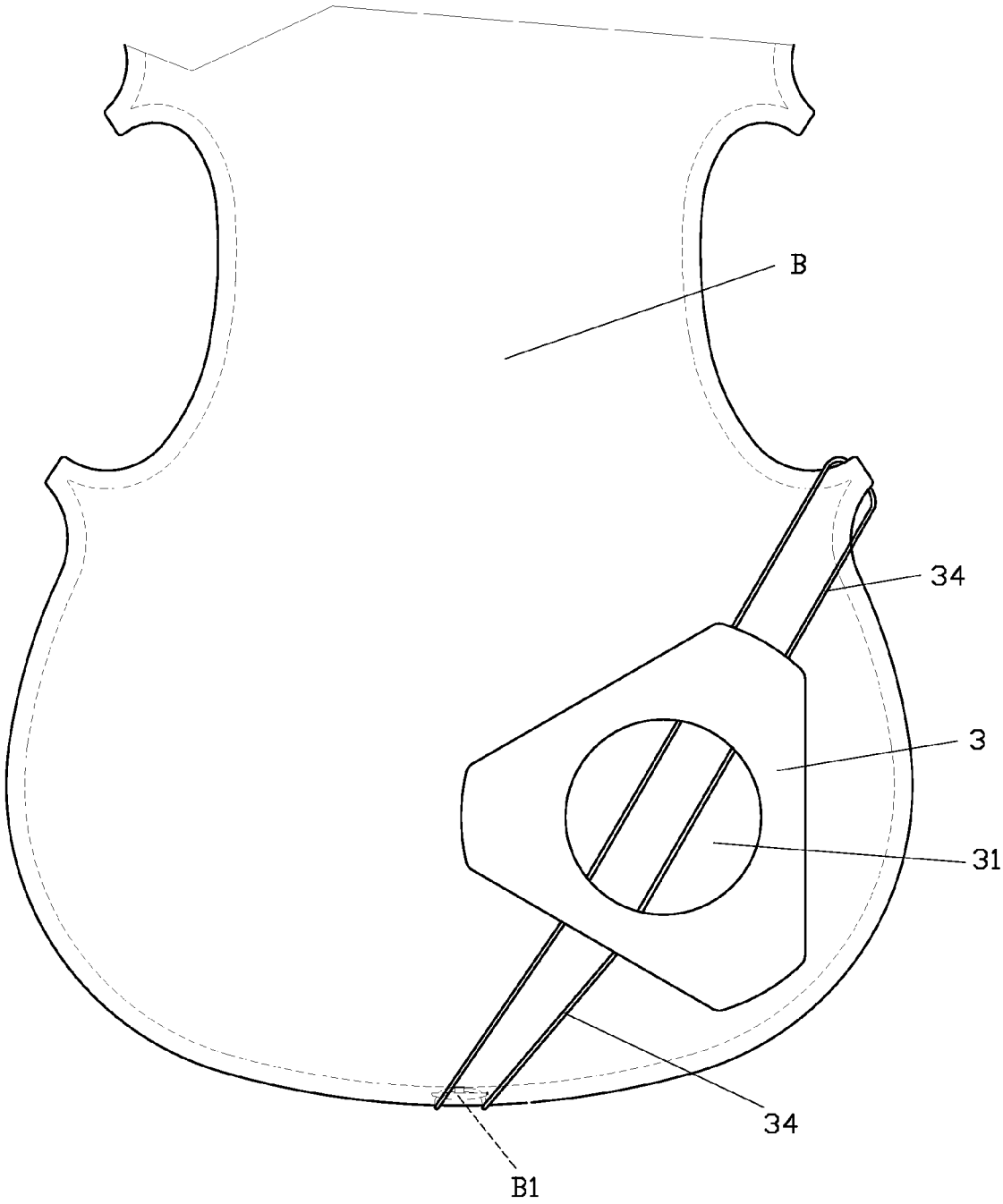
FIG. 5 is a schematic view showing adjustment of the location of a first pad with a resilient band of the first preferred embodiment of the present invention.

The location of the first pad (1) of the present invention on the tailpiece (B) is adjustable depending on the width of the shoulder socket of the player by age as illustrated in FIG. 5. The resilient band (34) located between the retainer (2) and the second pad (3) is tied and fixed to the tailpiece (B) and the end button (B1). The second pad (3) with the first pad (1) is moved to rest on the shoulder socket of the player for the player to deliver the optimal tone color of the performance.

Figure 6:
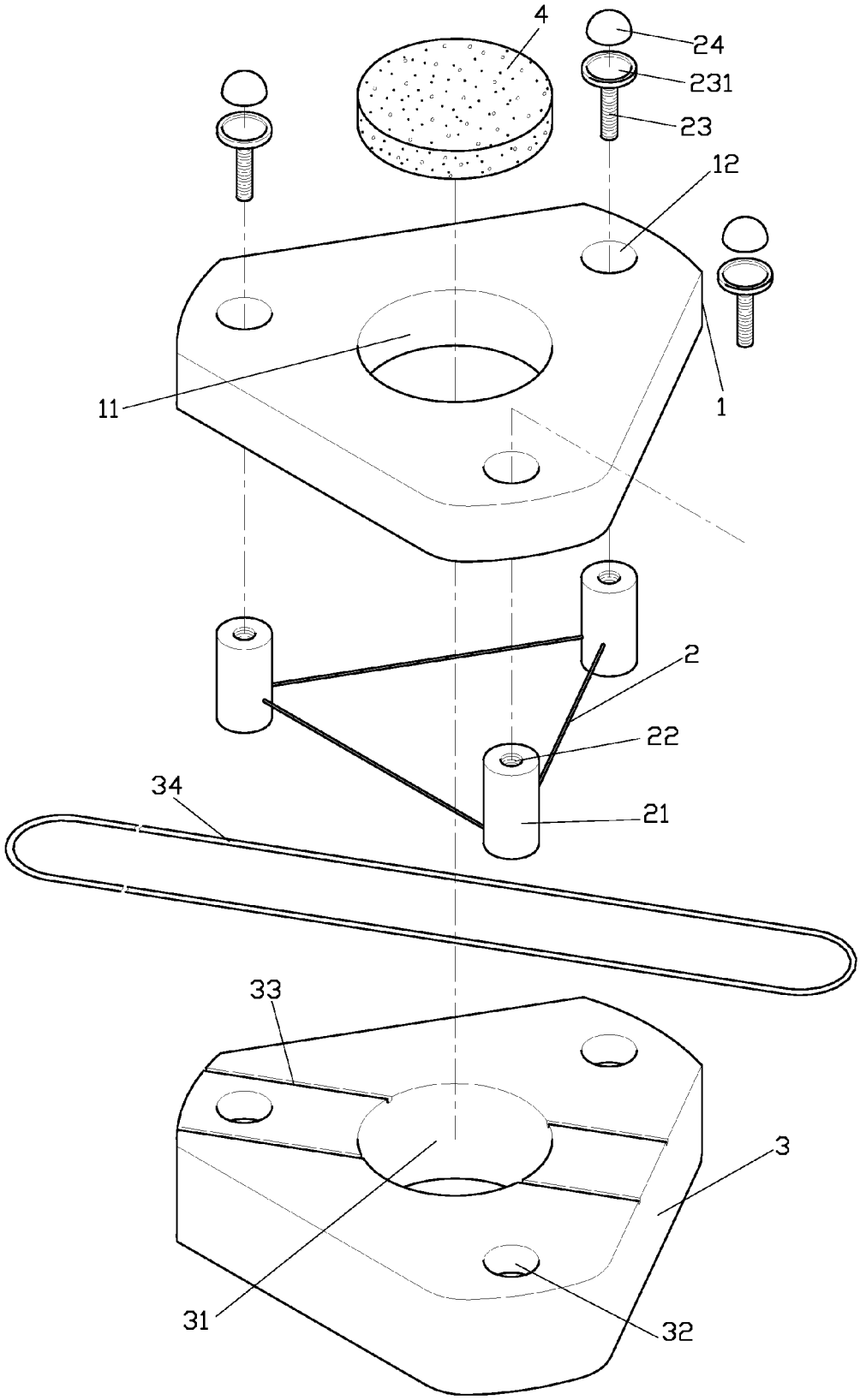
FIG. 6 is an exploded view of a second preferred embodiment of the present invention.

As illustrated in FIG. 6, a second preferred embodiment of the present invention comprises the first pad (1), the retainer (2), the second pad (3), and a piece of natural sponge block (4).

A through hole disposed at the center of the first pad (1) defines the sound reflection area (11); and the fixation holes (12), three in this preferred embodiment, are disposed on the first pad (1) for insertion of the upper portion of each fastening post (21) of the retainer (2). The threaded hole (22) in each fastening post (21) receives the insertion of the screw (23). The recess (231) disposed on the top of the screw (23) receives the insertion of the foot (24) made of silicon gel. The second pad (3) has the arc bottom surface (35). A through hole disposed at the center of the second pad (3) defines the sound reflection area (31). The second pad (3) comprises the fixation holes (32) for insertion of the lower portion of each fastening post (21) of the retainer (2). The two fillisters (33) disposed on the top of the second pad (3) accommodate the resilient band (34). The resilient band (34) extends through where between the retainer (2) and the second pad (3). The natural sponge block (4) is stuffed in the sound reflection area (11) of the first pad (1).

Figure 7:
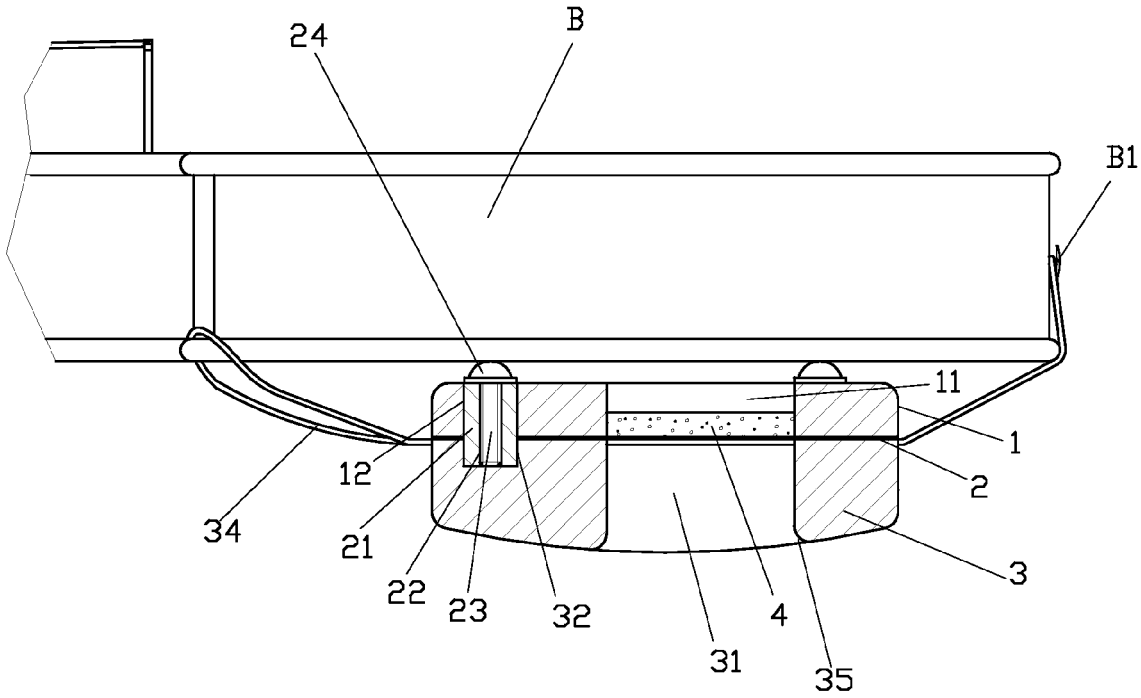
FIG. 7 is a schematic view showing an operating status of the second preferred embodiment of the present invention.

In practice, the resilient band (34) is tied and secured to the end button (B1) of the tailpiece (B), as illustrated in FIG. 7, with the second pad (3) holding against the shoulder socket (D) of the player as illustrated in FIG. 4. The soft foamed plastic material of the second pad (3) is harder than that of the first pad (1), and the second pad (3) has the arc bottom surface (35). By taking advantage of the delta contact provided by the second pad (3) to hold against the shoulder socket (D) also indicating a triangle, the tailpiece (B) is able to hold tightly against the three feet (24) of the first pad (1) and subject to the internal delta support by the three feet (24) for achieving ergonomically complying contact. The contact helps reduce the contact area between the first pad (1) and the tailpiece (B) without damaging the coating of the tailpiece (B). Therefore, the original sound quality will not be affected. By turning the section of the screw (23) below the foot (24), the angle of the first pad (1) can be easily adjusted to achieve a balanced status. For detail explanation, as shown in FIG. 4, the inside foot (24) is not adjusted. One of the outside feet (24A, 24B) is adjusted to half, and the other of the outside feet (24A, 24B) is adjusted to the highest. Alternatively, all of the three feet (24, 24A, 24B) may be adjusted to a desired height in a balanced status so as to provide the best timbre. Whereas the tailpiece (B) is at where opposite to the sound reflection area (11) of the first pad (1), the through hole configuration of the sound reflection area (11) stuffed with the natural sponge block (4) is particularly idea for the performance of chamber music including quartet by delivering more tender tone color and more harmonics for perfect infusion with sounds from instruments other than viola/violin.

Figure 8:
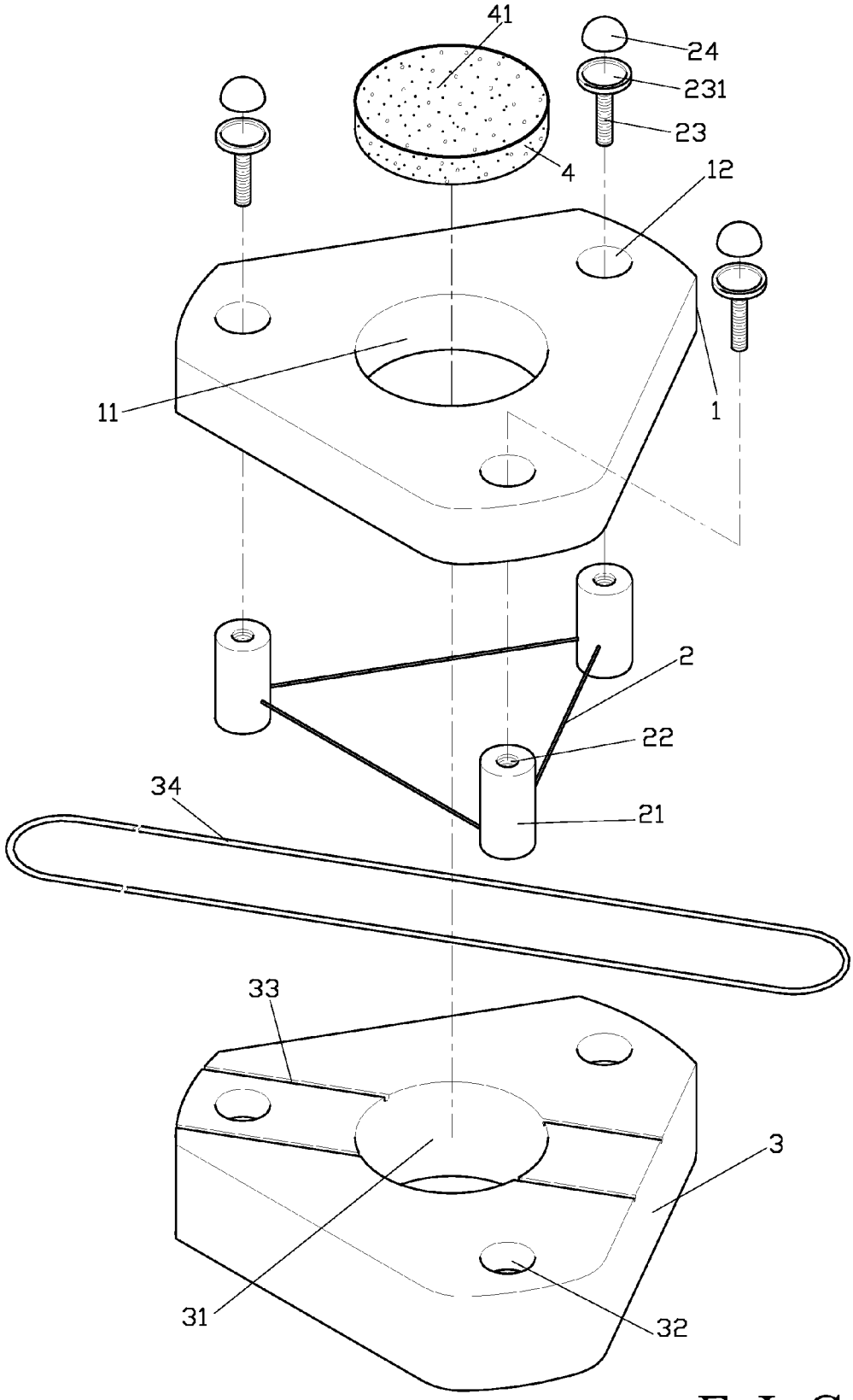
FIG. 8 is an exploded view of a third preferred embodiment of the present invention.

As illustrated in FIG. 8, a third preferred embodiment of the present invention comprises the first pad (1), the retainer (2), the second pad (3), and the natural sponge block (4).

A through hole disposed at the center of the first pad (1) defines the sound reflection area (11); and the fixation holes (12), three in this preferred embodiment, are disposed on the first pad (1) for insertion of the upper portion of each fastening post (21) of the retainer (2). The threaded hole (22) in each fastening post (21) receives the insertion of the screw (23). The recess (231) disposed on the top of the screw (23) receives the insertion of the feet (24) made of silicon gel. The second pad (3) has the arc bottom surface (35). A through hole disposed at the center of the second pad (3) defines the sound reflection area (31). The second pad (3) comprises the fixation holes (32) for insertion of the lower portion of each fastening post (21) of the retainer (2). The two fillisters (33) disposed on the top of the second pad (3) accommodate the resilient band (34). The resilient band (34) extends through where between the retainer (2) and the second pad (3). The piece of natural sponge block (4) is stuffed in the sound reflection area (11) of the first pad (1). The top of the natural sponge block (4) is coated with a gold foil (41).

Figure 9:
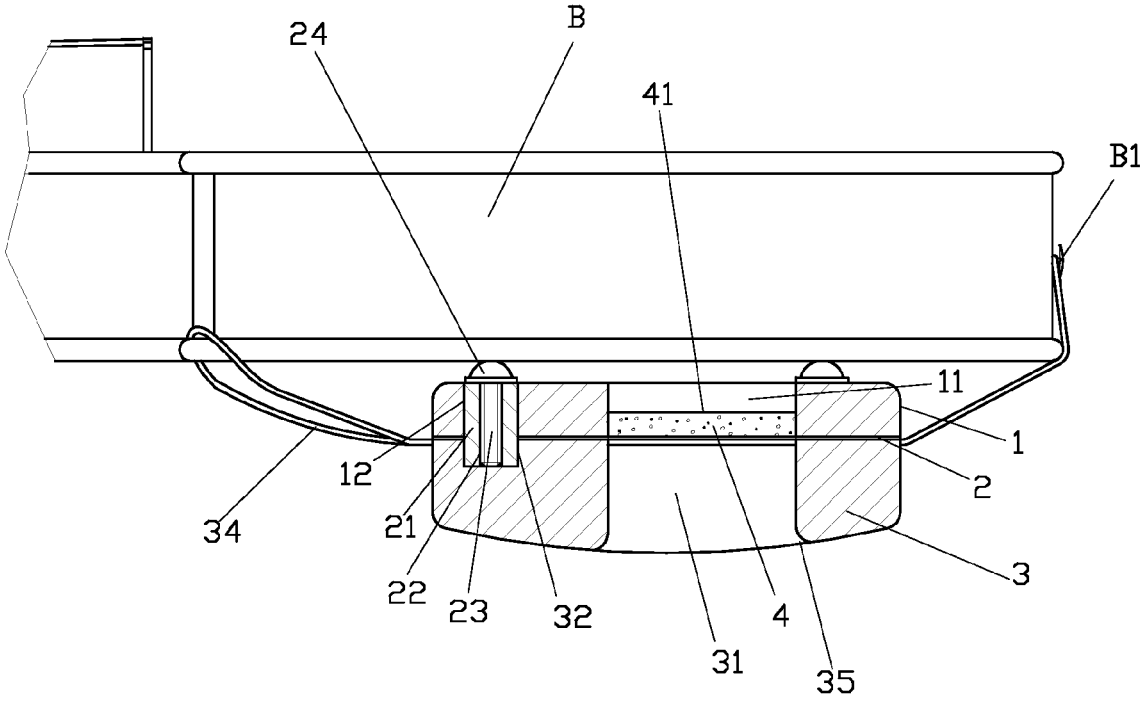
FIG. 9 is a schematic view showing an operating status of the third preferred embodiment of the present invention.
Figure 10:
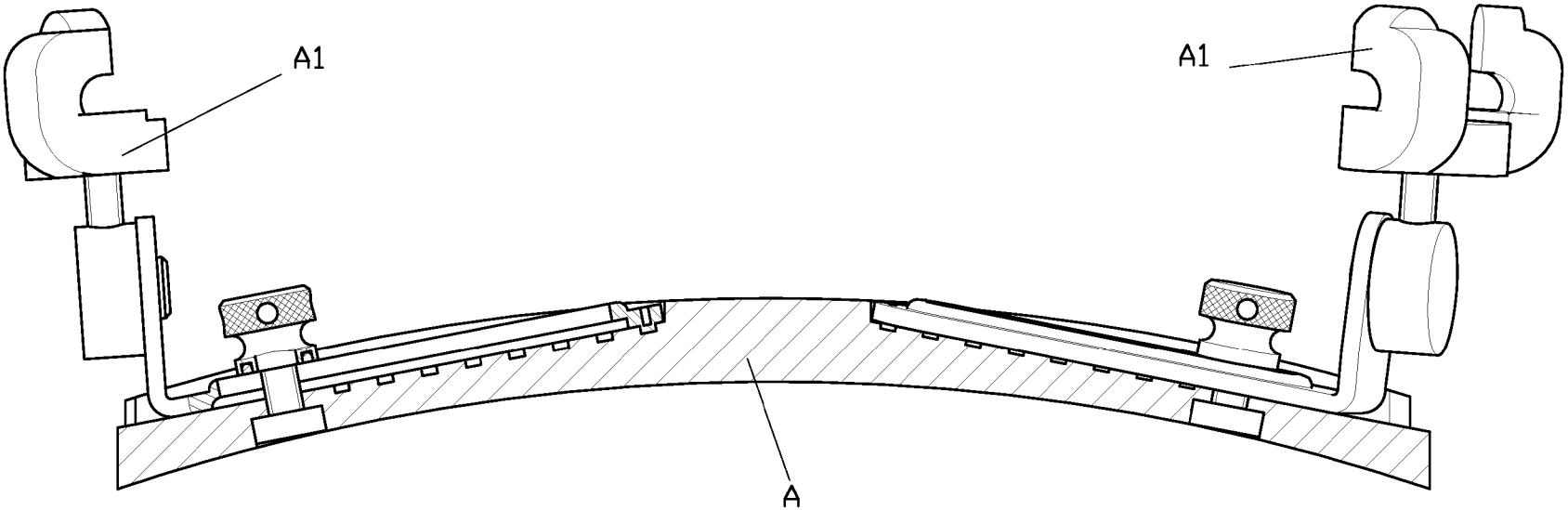
FIG. 10 (PRIOR ART)
FIG. 10 is a schematic view showing a viola/violin hard shoulder rest of the prior art.
Figure 11:
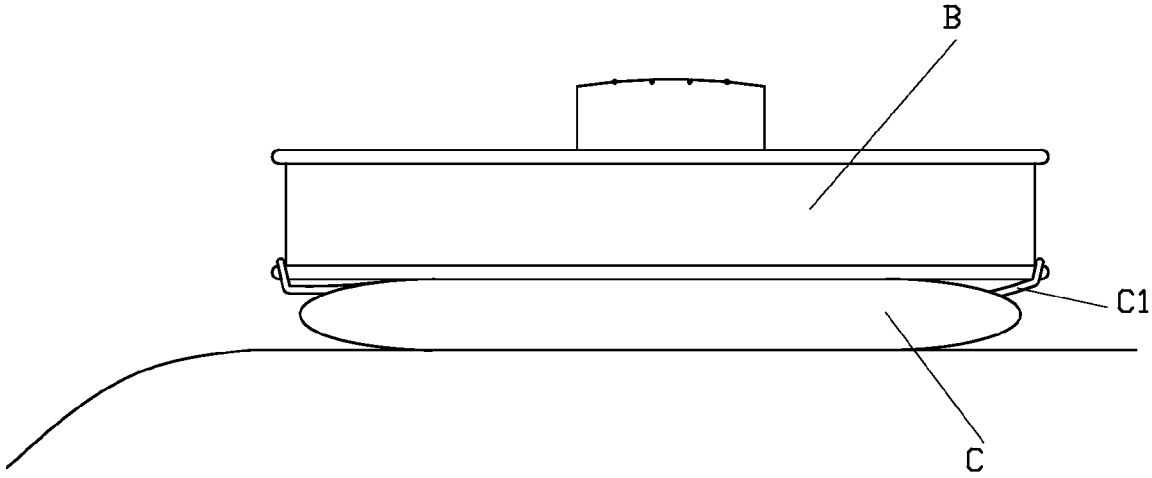
F I G . 11 (PRIOR ART)
FIG. 11 is a schematic view showing a viola/violin shoulder rest containing an airbag of the prior art.

In practice, the resilient band (34) is tied and secured to the end bottom (B1) of the tailpiece (B) as illustrated in FIG. 9 with the second pad (3) holding against the shoulder socket (D) of the player as illustrated in FIG. 4. The soft foamed plastic material of the second pad (3) is harder than that of the first pad (1), and the second pad (3) has the arc bottom surface (35). By taking advantage of the delta contact provided by the second pad (3) to hold against the shoulder socket (D) also indicating a triangle, the tailpiece (B) is able to hold tightly against the three feet (24) of the first pad (1) and subject to the internal delta support by the three feet (24) for achieving ergonomically complying contact. The contact helps reduce the contact area between the first pad (1) and the tailpiece (B) without damaging the coating of the tailpiece (B). Therefore, the original sound quality will not be affected. By turning the section of the screw (23) below the foot (24), the angle of the first pad (1) can be easily adjusted to achieve a balanced status. For detail explanation, as shown in FIG. 4, the inside foot (24) is not adjusted. One of the outside feet (24A, 24B) is adjusted to half, and the other of the outside feet (24A, 24B) is adjusted to the highest. Alternatively, all of the three feet (24, 24A, 24B) may be adjusted to a desired height in a balanced status so as to provide the best timbre. Whereas the tailpiece (B) is at where opposite to the sound reflection area (11) of the first pad (1), the through hole configuration of the sound reflection area (11) stuffed with the natural sponge block (4) coated on its top the gold foil (41) is particularly idea for the performance of concerto with the enhanced penetration of the sound through the gold foil (41) to deliver firm and bright sound to counter sounds from the orchestra when the viola/violin player the primary player, thus to clearly highlight the sound color of the primary instrument.

What is claimed is:

1. A viola/violin shoulder rest comprising a first pad and a second pad; each of the first pad and the second pad being made of soft foamed plastic material and in the form of a triangle; a retainer being disposed between the first and the second pads; each of the first pad and the second pad being disposed with a sound reflection area defined by a through hole; a plurality of feet made of silicon gel being fixed on the first pad in delta arrangement; and a resilient band extending through where between the retainer and the second pad.

2. The viola/violin shoulder rest as claimed in claim 1, wherein the sound reflection area of the first pad is stuffed with a piece of a natural sponge block.

3. The viola/violin shoulder rest as claimed in claim 2, wherein the top of the natural sponge block is coated with a gold foil.

4. The viola/violin shoulder rest as claimed in claim 1, wherein each of the feet indicates a ball shape.

5. The viola/violin shoulder rest as claimed in claim 1, wherein a plurality of fixation holes are disposed on the first pad and the second pad; the retainer is provided with a plurality of fastening posts corresponding in position to the fixation holes; each fastening post is disposed with a threaded hole to receive a screw; and a recess is disposed on the top of the screw to receive the foot.

6. The viola/violin shoulder rest as claimed in claim 1, wherein two groove are disposed on a top surface of the first pad to accommodate the resilient band.

7. The viola/violin shoulder rest as claimed in claim 1, wherein the soft foamed plastic material of the second pad is harder than that of the first pad.

8. The viola/violin shoulder rest as claimed in claim 1, wherein the second pad has an arc bottom surface.

* * * * *